US008109477B1

(12) United States Patent
Blasbalg

(10) Patent No.: US 8,109,477 B1
(45) Date of Patent: Feb. 7, 2012

(54) LAWN BAG CART

(76) Inventor: Jordan Blasbalg, East Greenwich, RI (US)

( * ) Notice: Subject to any disclaimer, the term of this patent is extended or adjusted under 35 U.S.C. 154(b) by 396 days.

(21) Appl. No.: 12/335,628

(22) Filed: Dec. 16, 2008

Related U.S. Application Data

(60) Provisional application No. 61/014,880, filed on Dec. 19, 2007.

(51) Int. Cl.
*A63B 55/08* (2006.01)

(52) U.S. Cl. ..... 248/98; 248/101; 248/129; 248/145.6; 248/153; 248/175; 280/47.24

(58) Field of Classification Search ..... 248/98, 248/95, 97, 99, 101, 128, 129, 145.6, 153, 248/175, 682; 280/47.24, 47.26, 47.27, 47.28, 280/47.29; 211/70.6
See application file for complete search history.

(56) References Cited

U.S. PATENT DOCUMENTS 3,162,462 A * 12/1964 Elders ..... 280/47.35
3,797,847 A * 3/1974 Lindsey et al. ..... 280/654
3,815,933 A * 6/1974 Olson ..... 280/47.35
5,159,875 A * 11/1992 Cohen ..... 100/34
6,199,802 B1 * 3/2001 Scheibe, Sr. ..... 248/97
6,325,341 B1 12/2001 Brown
6,869,097 B2 * 3/2005 Prather et al. ..... 280/651
2005/0103950 A1 * 5/2005 Joubert ..... 248/98
* cited by examiner

*Primary Examiner* — Anita M King
(74) *Attorney, Agent, or Firm* — Salter & Michaelson

(57) ABSTRACT

A bag holding apparatus for supporting one or more bags that are used for the purpose of depositing and storing leaves or other lawn debris. The apparatus includes a base platform upon which a full bag rests; at least two wheels interconnected by an axle shaft and for supporting the base platform; an upright main frame mounted from the base platform and disposed over the wheels; and sidewall members also supported over the base platform and defining with the main frame an open compartment for receiving the bag therein. Each of the sidewall members has a lower section thereof positioned to leave a space between the sidewall member and an edge of the bag and an upper section extending inwardly of the compartment. A clip member is secured at the upper section of each sidewall member for holding an edge of the bag.

21 Claims, 14 Drawing Sheets

LAWN BAG CART

RELATED CASES

Priority for this application is hereby claimed under 35 U.S.C. §119(e) to commonly owned and U.S. Provisional Patent Application No. 61/014,880 which was filed on Dec. 19, 2007 and which is incorporated by reference herein in its entirety.

TECHNICAL FIELD

The present invention relates in general to a bag holder/carrier and pertains, more particularly, to a handcart that may be used to independently hold one or more paper bags that are used for gathering leaves and lawn debris.

BACKGROUND OF THE INVENTION

Recyclable paper bags are typically used for gathering leaves and twigs and lawn clippings. Various types of apparatuses exist for gathering leaves. A typical means is a barrel type container into which is mounted a plastic or paper bag that is then stuffed with the leaves or other debris. One problem with existing arrangements is that when the bag gets full it is difficult to remove the bag from the container as the bag has expanded considerably and is wedged inside the container making it difficult to remove the full bag.

Accordingly, it is an object of the present invention to provide an improved holder for supporting a bag and in which the bag can be readily removable from the holder once the bag is filled.

Another object of the present invention to provide a lawn bag cart that may be used for holding one or more leaf bags and for also readily transporting the bags once filled.

SUMMARY OF THE INVENTION

The foregoing and other objects, features and advantages are accomplished in accordance with the present invention by providing a carrier or cart that is preferably a wheeled cart having foldable sides and either a removable or a foldable bottom. The sides can be folded to a compact closure position when the cart is not in use and can be opened so that the bottom can support one or more leaf bags thereon. The sides of the carrier may also be removable. A storage pocket may also be provided on the cart for storing folded bags.

In accordance with the invention, the bag is preferably maintained by securing clips at the top of each side wall that hold opposed edges of the bag. Once the leaves and lawn debris are filled into the bag and compressed, the weight of the leaves and lawn debris themselves release the top edges of the bag from the securing clips enabling the bag to be readily removed from the carrier. An intermediate wall may also be provided with associated clips when two bags are to be supported on the carrier.

In accordance with the present invention there is provided a bag holding apparatus for supporting one or more bags that are used for the purpose of depositing and storing leaves or other lawn debris. The apparatus comprises a base platform upon which a full bag rests; at least two wheels interconnected by an axle shaft and for supporting the base platform; an upright main frame mounted from the base platform and disposed over the wheels; sidewall members also supported over the base platform and defining with the main frame an open compartment for receiving the bag therein; wherein each of the sidewall members has a lower section thereof positioned to leave a space between the sidewall member and an edge of the bag and an upper section extending inwardly of the compartment and clip means secured at the upper section of each sidewall member for holding an edge of the bag.

Other features of the lawn bag apparatus include the base platform comprises a flat base and further including pivot means for pivotally supporting the flat base from the wheel axle; each sidewall member includes a bottom wire piece and the flat base has side edges that engage respective bottom wire pieces to hold the sidewall members in place; the base platform comprises a removable base grid that is supported adjacent the main frame and also from the sidewall members; a pocket is provided at the top of the main frame for retaining one or more bags therein in their folded condition; further including a compacting pole and tab means for supporting the compacting pole from the main frame; the upright main frame includes a horizontal handle bar and a pair of vertical side legs; including a stop on one of the side legs below the tab means that functions as a stop for the pole; each of the sidewall members comprises a metal sidewall grid and the upper section thereof includes a top wire piece from which the clip means is supported; the clip means comprises a pair of alligator clips supported from each respective top wire piece; each bag has a predetermined bag width and height, and the distance between the lower sections of the sidewall members is greater than the predetermined width of the bag so as to leave said space; the lower sections of the respective sidewall members leaves a space on the order of 1 inch on either side thereof; each sidewall member has a height that is greater than the predetermined bag height so as to leave a space below the bag; each sidewall member comprises a metal sidewall grid and the upper section thereof includes an inwardly tapered section; and including a vertically disposed divider wall extending from the base platform and forming separate side-by-side compartments for receiving respective bags.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 12:
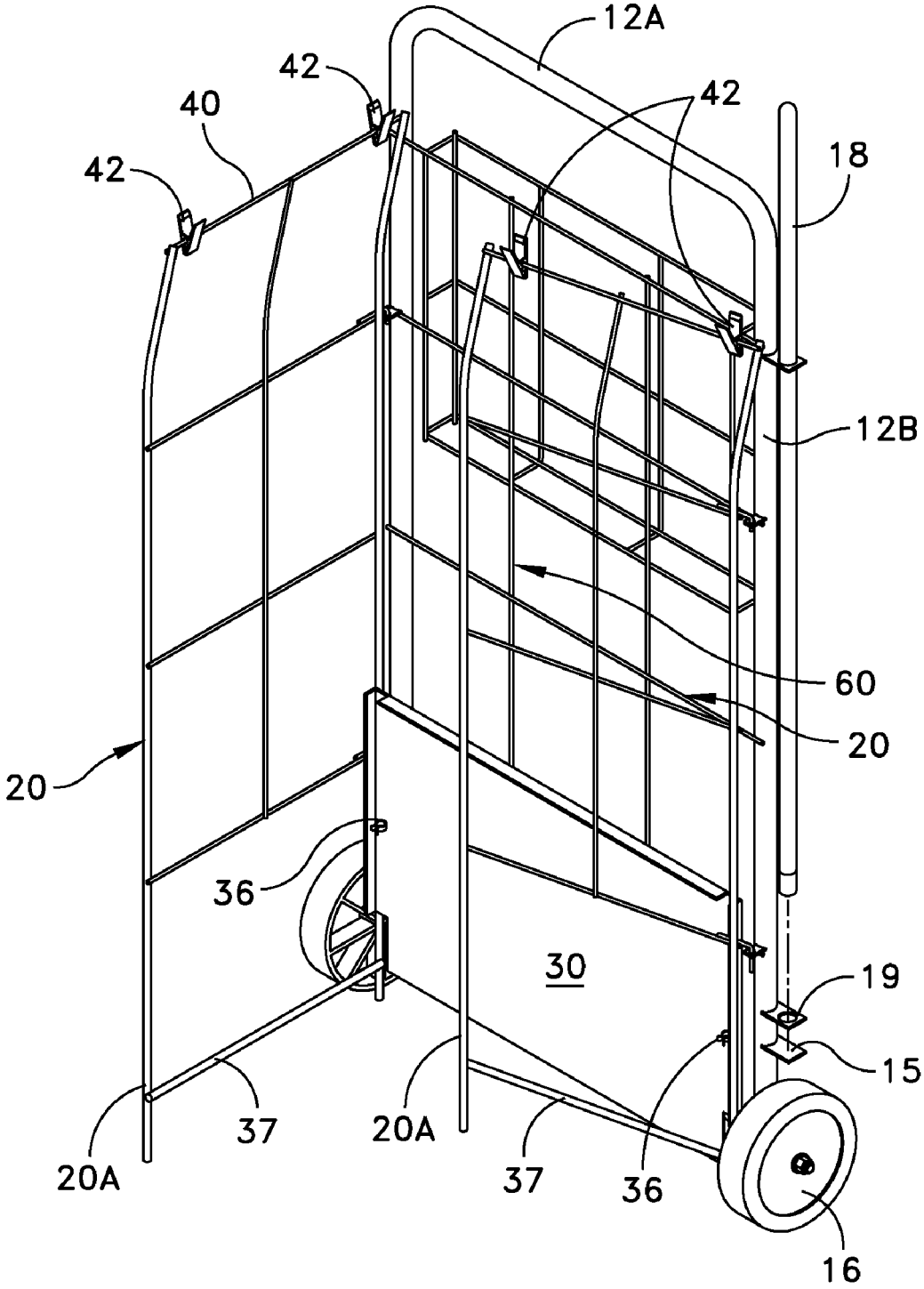
FIG. 12 is a perspective view showing the manner in which the bottom and the side walls may be folded.
Figure 13:
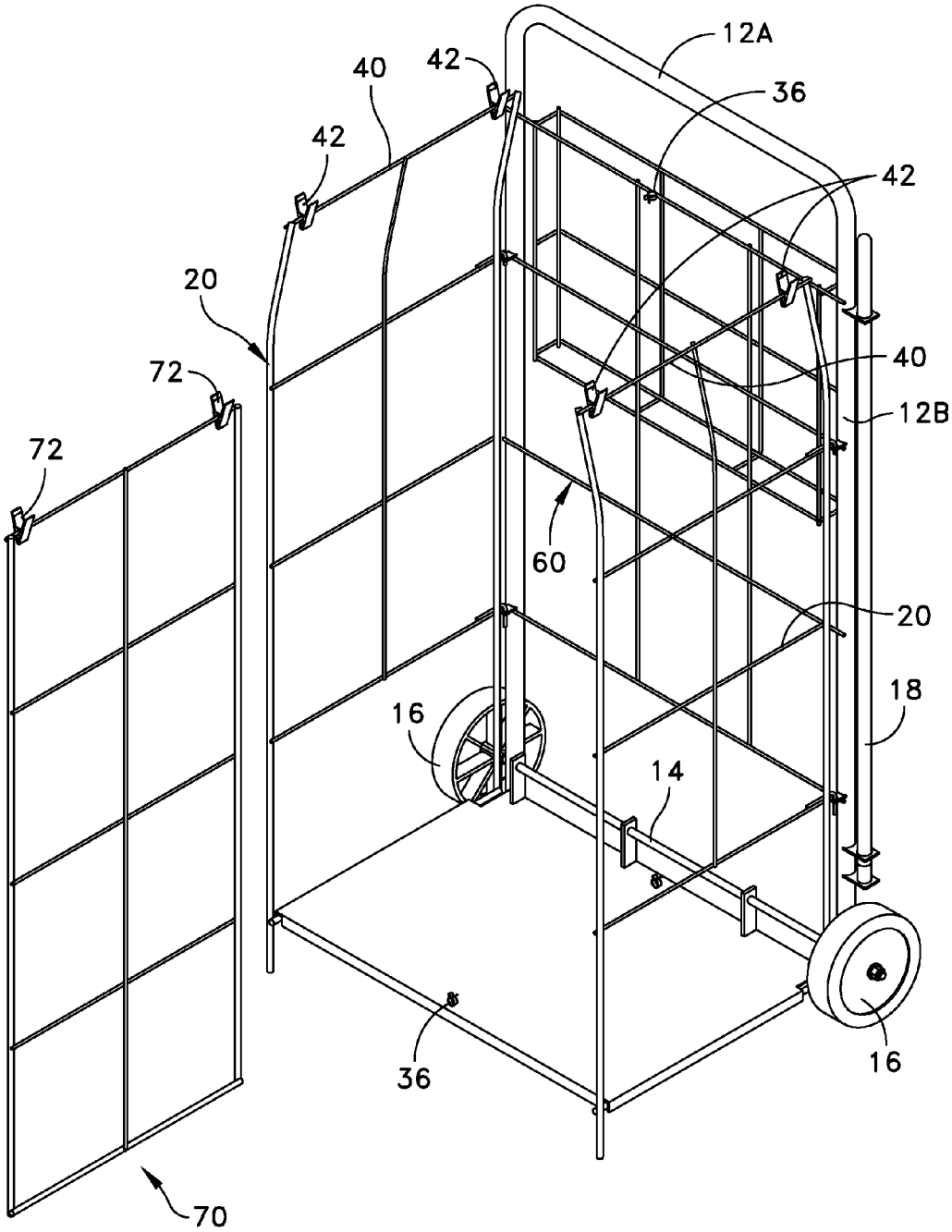
FIG. 13 shows an alternate embodiment in which a separate intermediate wall may be provided for accommodating two bags.
Figure 14:
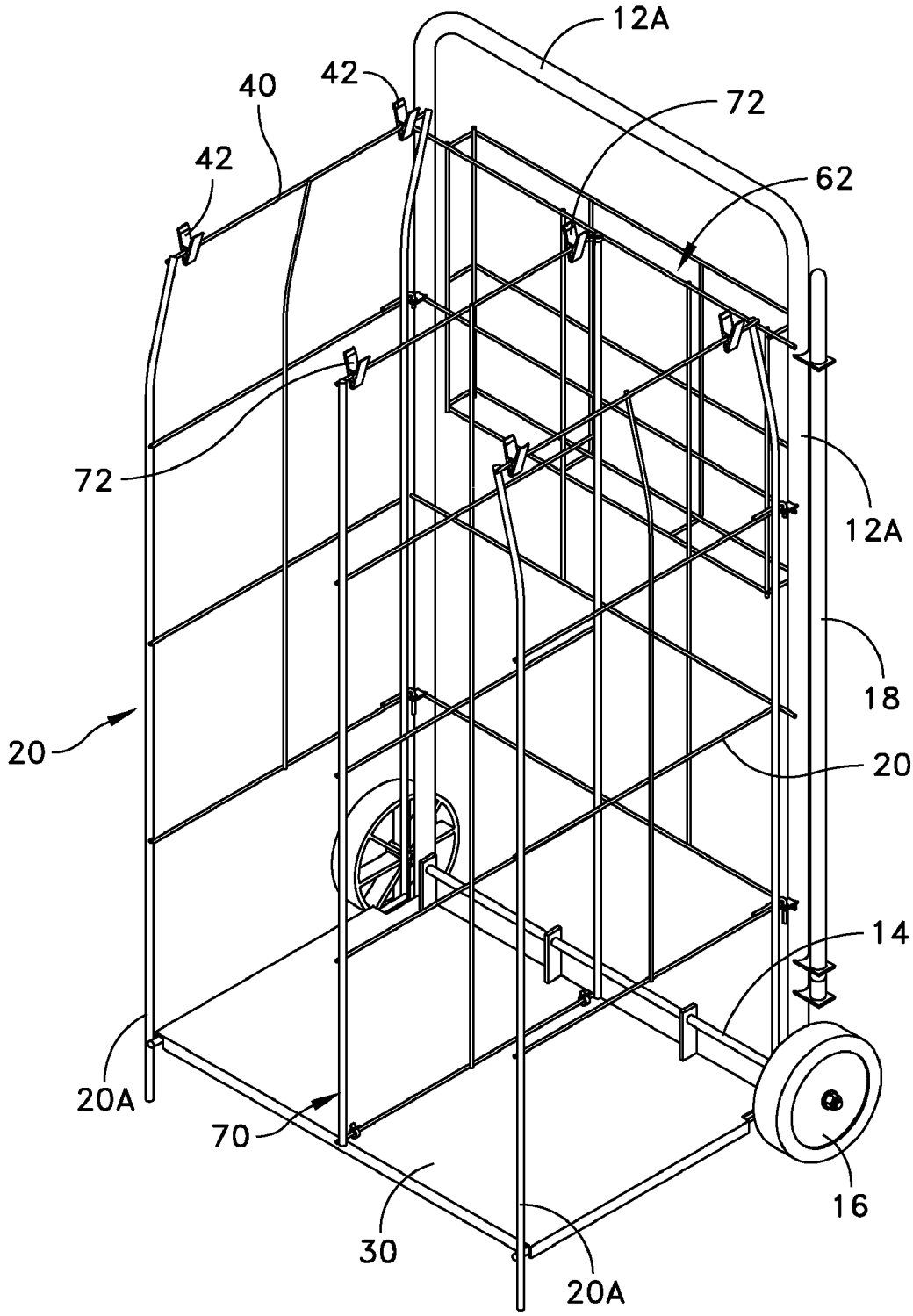
FIG. 14 is a perspective view showing the intermediate wall as secured in place.
Figure 15:
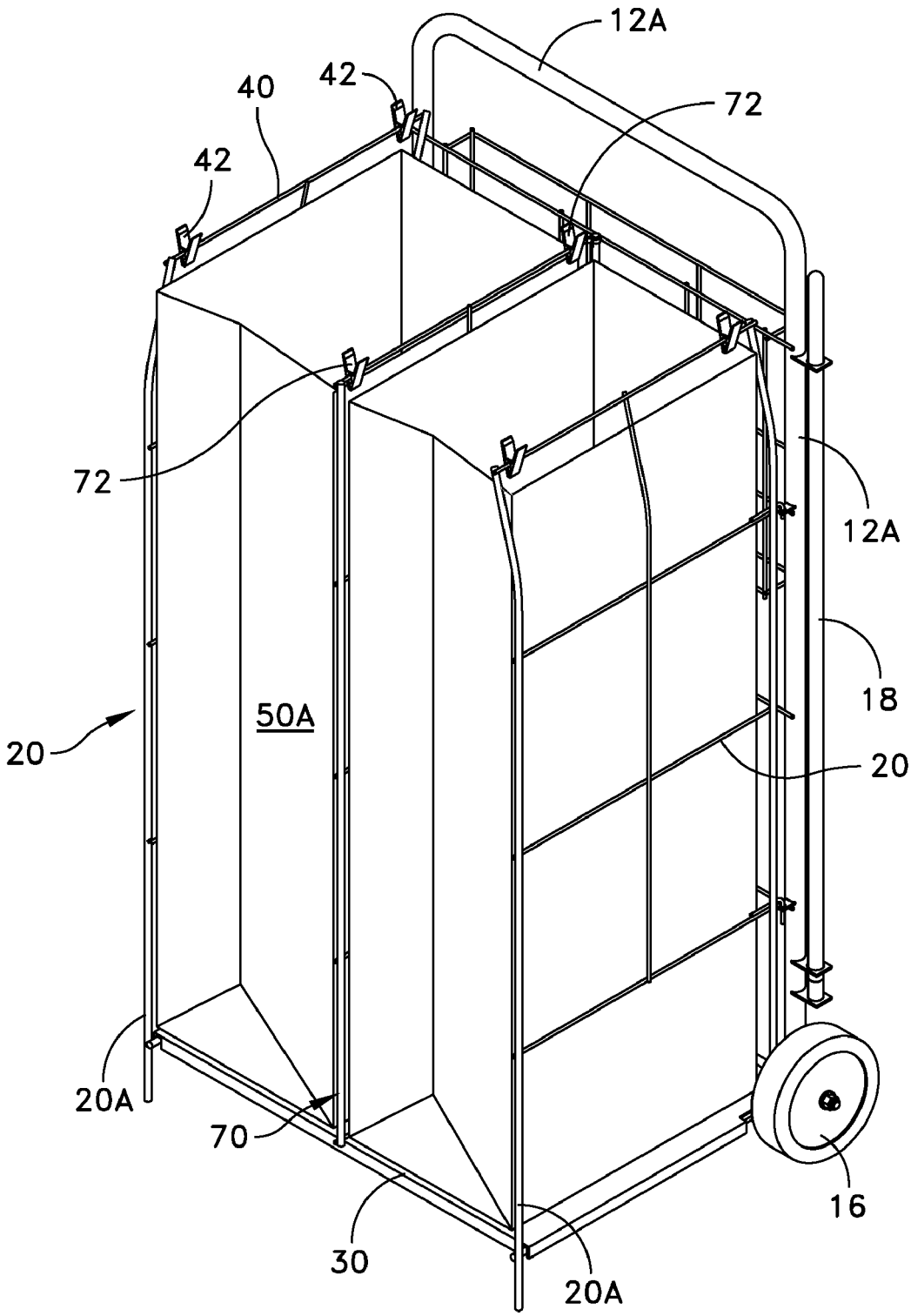
FIG. 15 is a perspective view like that shown in FIG. 14 with one bag in place.
Figure 16:
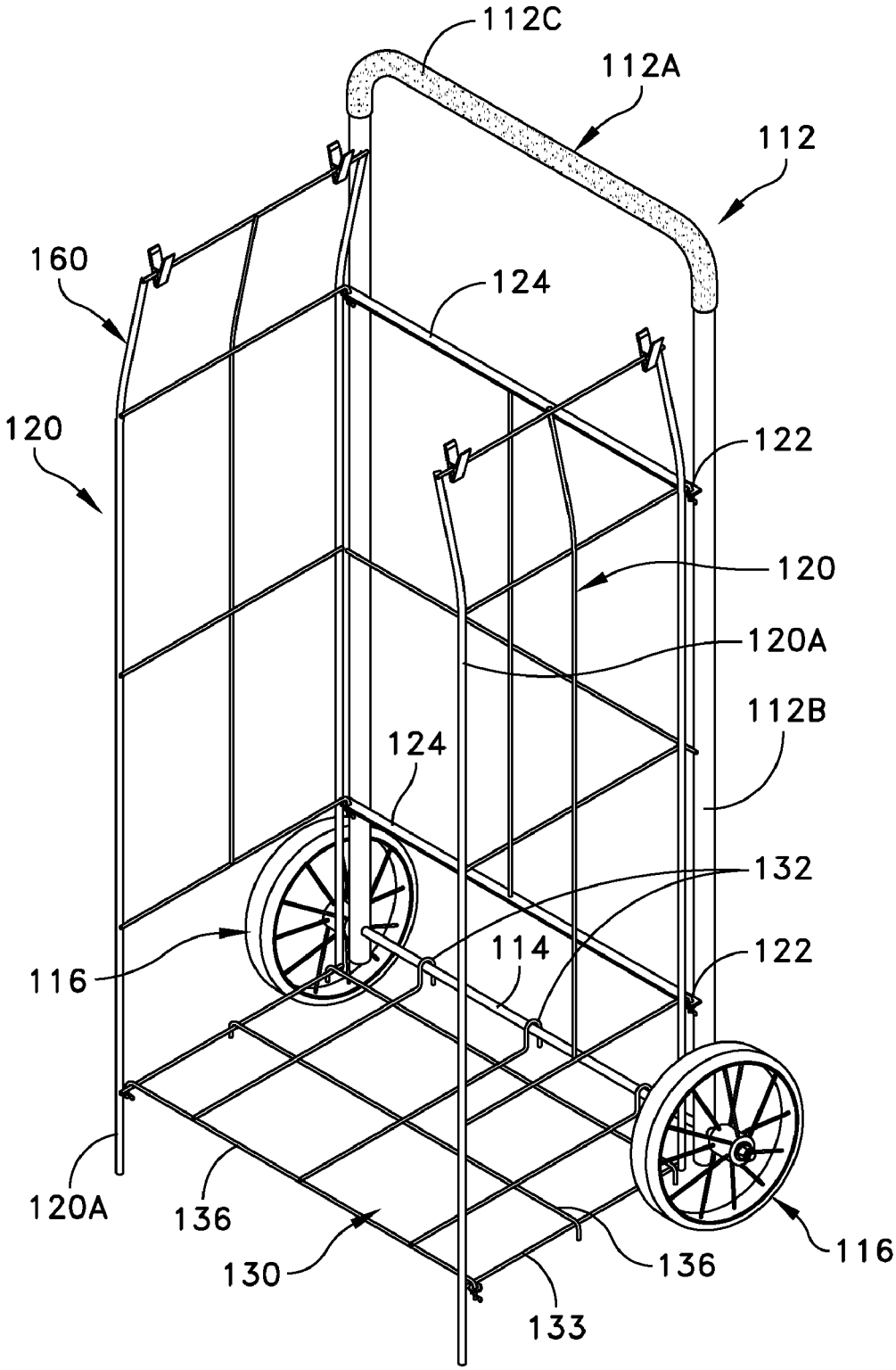
FIG. 16 is a perspective view of a preferred embodiment of the bag cart of the present invention.

Referring now to the drawings, FIGS. 1-12 illustrate one embodiment of the present invention in which the bag holder/carrier is used for the support of a single bag. A second embodiment is illustrated in FIGS. 13-15 wherein an intermediate wall is used for separating the carrier or cart into two separate compartments for carrying two respective bags that are arranged side-by-side.

The first embodiment describes a lawn bag carrier that is basically comprised of a main frame 12 that includes a handle bar 12A and side legs 1213 that are integrally formed with the handle bar 12A. At the lower ends of the legs 1213 there is supported an axle 14 that supports at either end thereof a wheel 16. The axle 14 and wheels 16 may be of conventional design. This arrangement enables the carrier to be easily rolled from place to place. As illustrated in, for example, FIGS. 1 and 2 adjacent to one of the legs 1213 there is provided a pole 18 that is supported at tabs 19. The tabs 19 are fixed at spaced positions along the leg 1213, and each one is provided with a hole for receiving the pole 18. Also attached to the leg 128 is a stop 15, positioned just below one of the tabs 19 and that is used as a rest for the bottom of the pole 18. The pole 18 may be easily withdrawn from the tabs 19 and is usable to assist in stuffing leaves and lawn debris in the bag.

In this first embodiment the carrier also includes sidewall members 20, each of which is in the form of interconnected metal rods forming a grid pattern and including front legs 20A. The bottom of each leg 20A may be pointed so that the carrier, when in its usable position, can be partially stuck into the ground for securing the position of the carrier. As illustrated in, for example, FIG. 1 each sidewall is formed by welding together separate wires into a grid pattern. Although a grid arrangement if preferred, in accordance with the present invention other sidewall arrangements may be provided including, but not limited to, a relatively flat and light weight sheet material.

Figure 6:
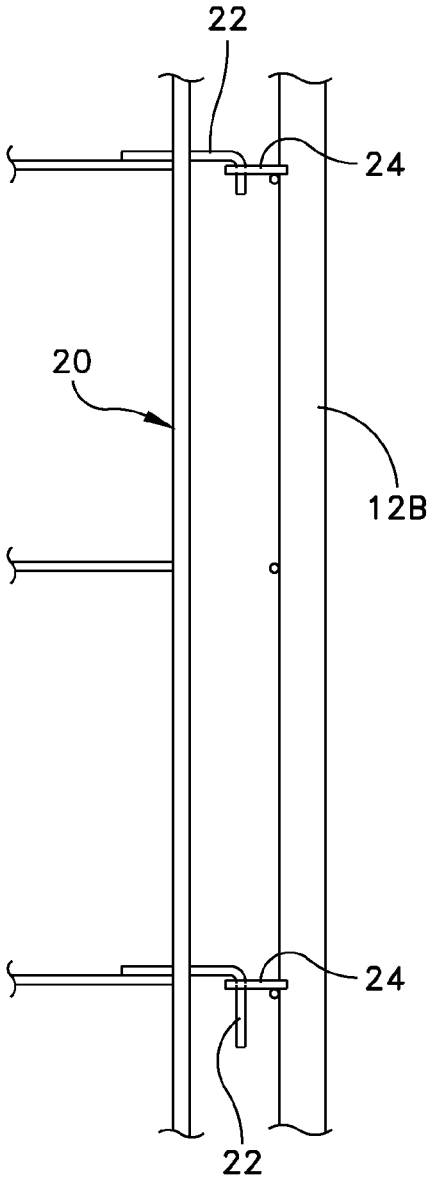
FIG. 6 is a partial side elevation view.
Figure 7:
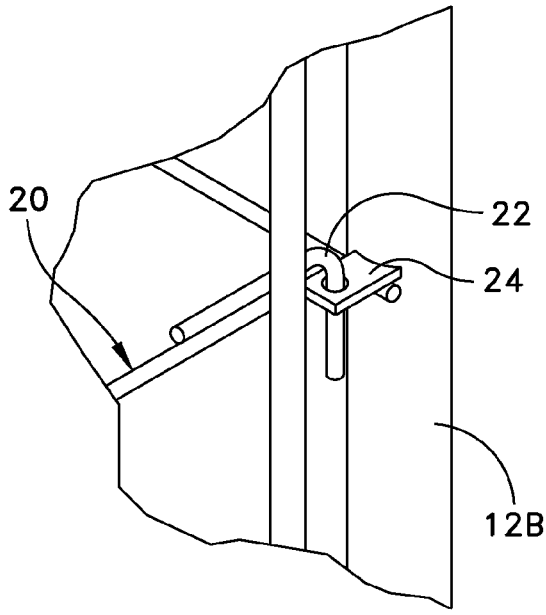
FIG. 7 is a fragmentary perspective view showing the interlocking of the side walls.
Figure 8:
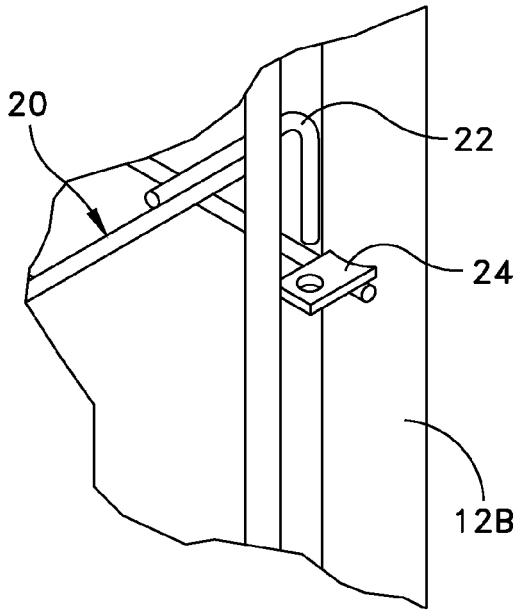
FIG. 8 is a fragmentary perspective view similar to that show in FIG. 7 with the side wall having been disengaged.

The sidewalls 20 are preferably releasably or removably supported and for that purpose associated with each side wall is a hook 22 that engages with a hole in a tab 24. The tabs 24 are spatially disposed and secured to each of the respective legs 12B of the main frame of the carrier. Refer now also to FIGS. 6-8 which show further details of the hook 22 and the tab 24 that is engaged by the hook. The lower hook 22 may be made longer than the upper located hooks so as to easily guide the upper hook into its associated tab. FIG. 7 shows the sidewall 20 in its engaged position while FIG. 8 illustrates the sidewall 20 having been lifted so that the hook 22 disengages from the associated tab 24. This engagement of the hook 22 at the tab 24 also provides a pivot so that the sidewalls can be pivoted inwardly such as is illustrated in FIG. 12 where one of the sidewalls is shown partially folded to convert the cart for storage thereof. FIG. 12 illustrates one of the side walls folded inwardly while the other sidewall is yet to be folded inwardly. The other side wall may also be folded inwardly in a similar manner using the hook as a pivot point. This makes for a much more compact carrier when, not only the sidewalls can be folded in, but also the bottom can be folded up, as illustrated in FIG. 12. In the drawings two hooks and tabs are used, but it should be understood that more than two may be provided.

Figure 4:
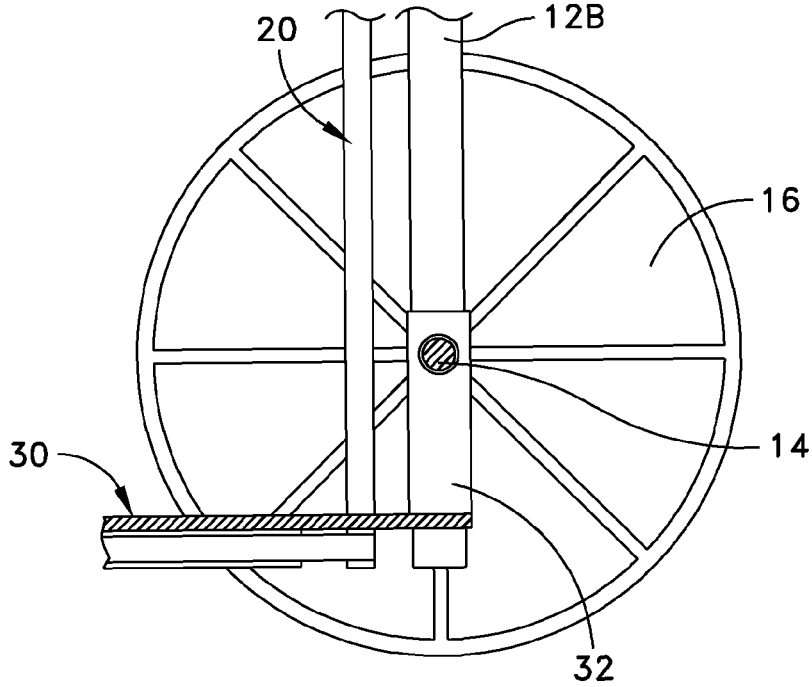
FIG. 4 is a cross-sectional view taken along line 4-4 of FIG. 2.
Figure 5:
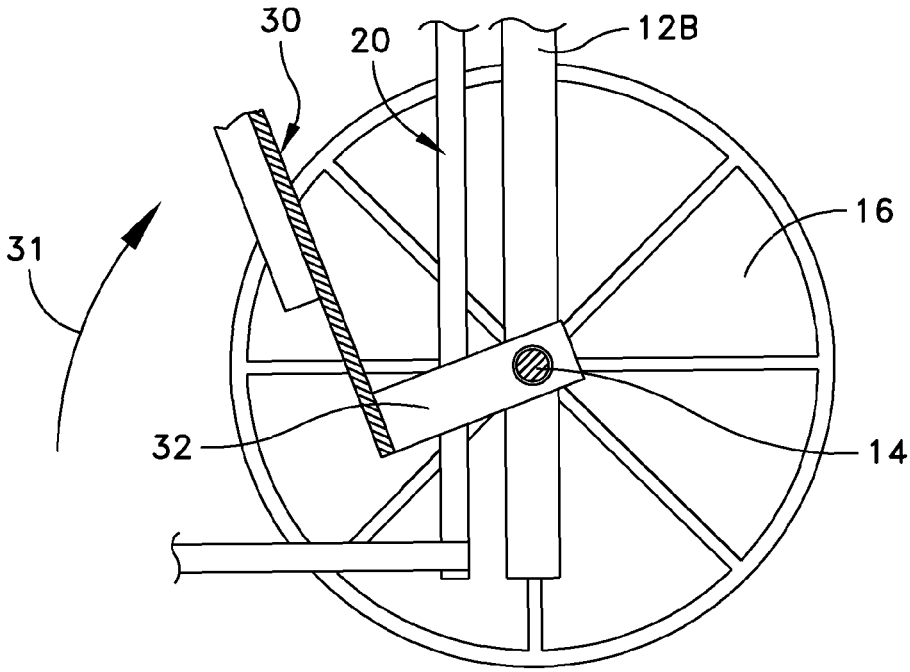
FIG. 5 is a view similar to that shown in FIG. 4 but with the bottom or base raised.

In this first embodiment the bag carrier also includes a bottom or base wall 30 that can pivot from the axle 14. For this purpose there are provided pivot plates 32. These pivot plates 32 also lower the bottom plate 30 relative to the axle 14. Refer to FIGS. 4 and 5 that show these plates 32 pivoted about the axle 14 for moving the base 30. FIG. 5 illustrates by the arrow 31 the pivotal raising of the base plate 30 such as to the position illustrated in FIG. 12. Because each of these plates 32 has a certain length, the sidewalls 20 could be pivoted first with the base pivoted afterwards, or, alternatively, if the plates are shorter then the sidewalls can pivot on top of the base as illustrated in FIG. 12.

Figure 2:
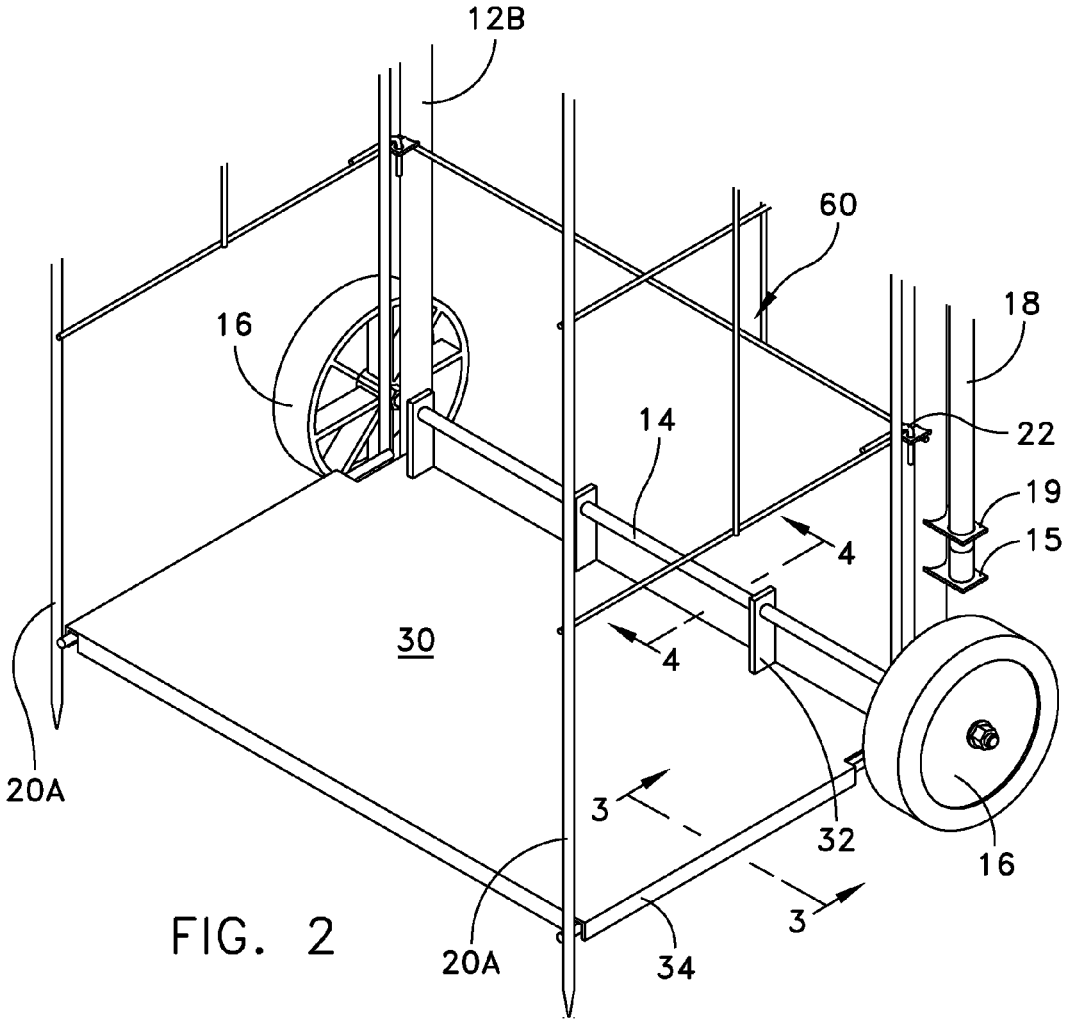
FIG. 2 is an enlarged fragmentary view at the bottom of the carrier of FIG. 1.
Figure 3:
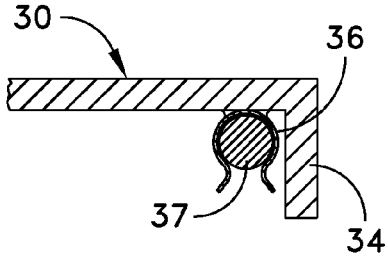
FIG. 3 is a cross-sectional view taken along line 3-3 of FIG. 2.

As illustrated in FIGS. 2 and 3, the base 30 preferably has an edge wall 34 that includes a releasable retaining clip 36 that is releasably engageable with the wire 37. The wire 37 forms a part of the wire grid arrangement of each of the sidewalls 20. The base 30 can be easily disengaged from the wire 37 by lifting the base. A pair of clips 36 may be provided on each side of the base 30 that, when engaged, provide rigidity of the sidewalls and bottom.

Figure 9:
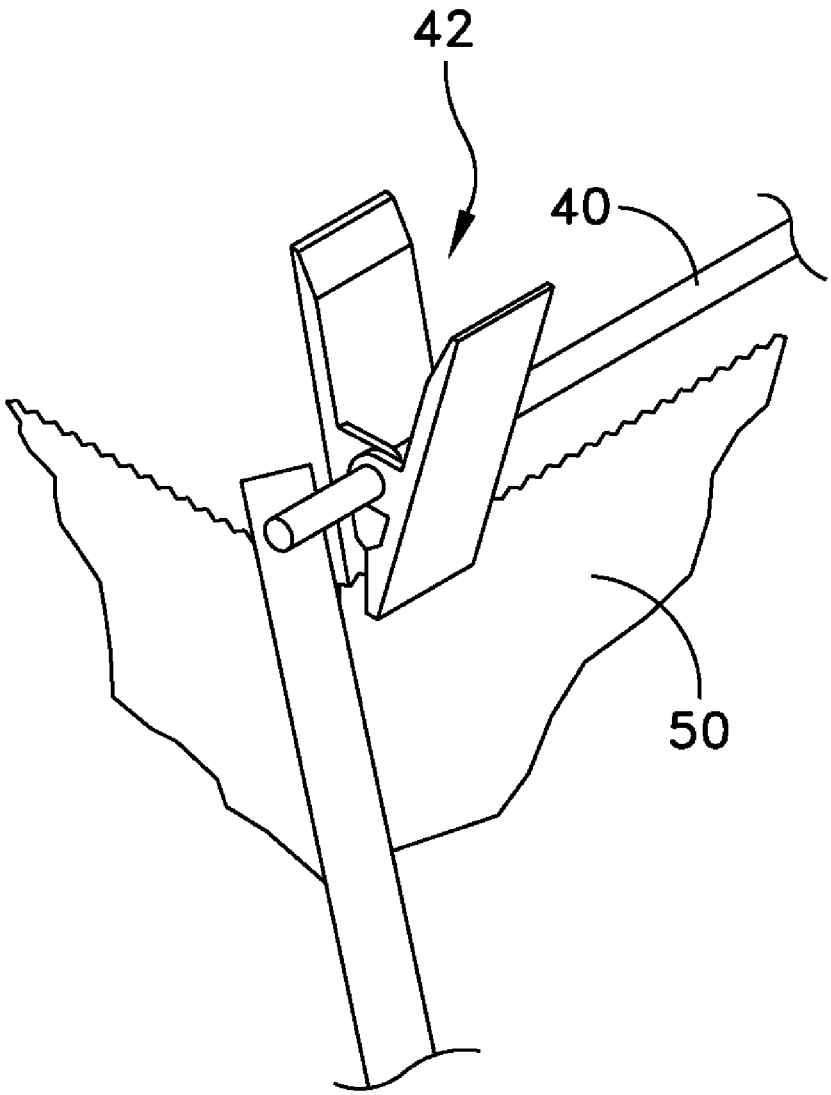
FIG. 9 is a fragmentary perspective view illustrating one of the securing clips attached to the bag.
Figure 10:
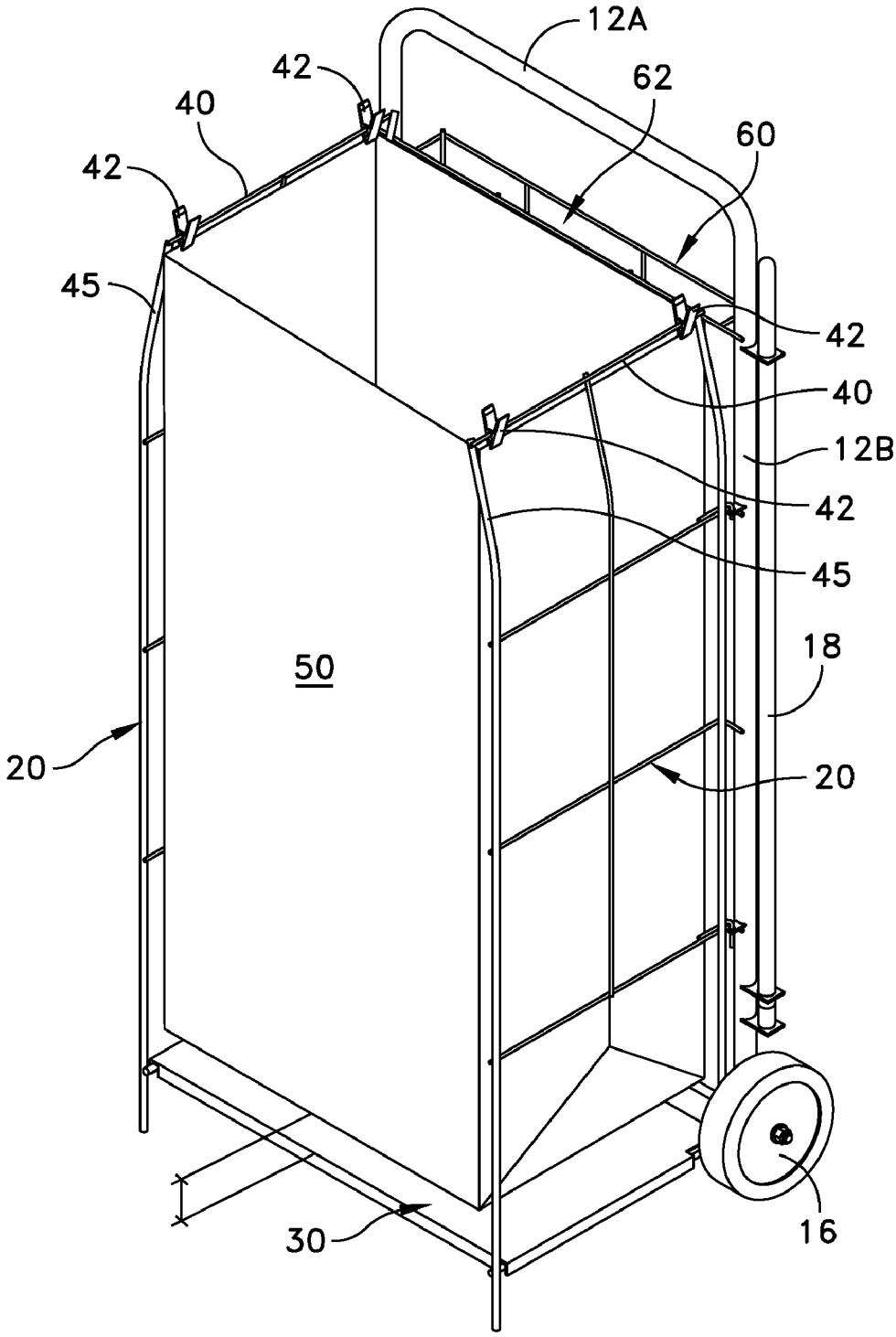
FIG. 10 is a perspective view similar to that shown in FIG. 1 with a bag in place and securing clips attached to the bag.
Figure 11:
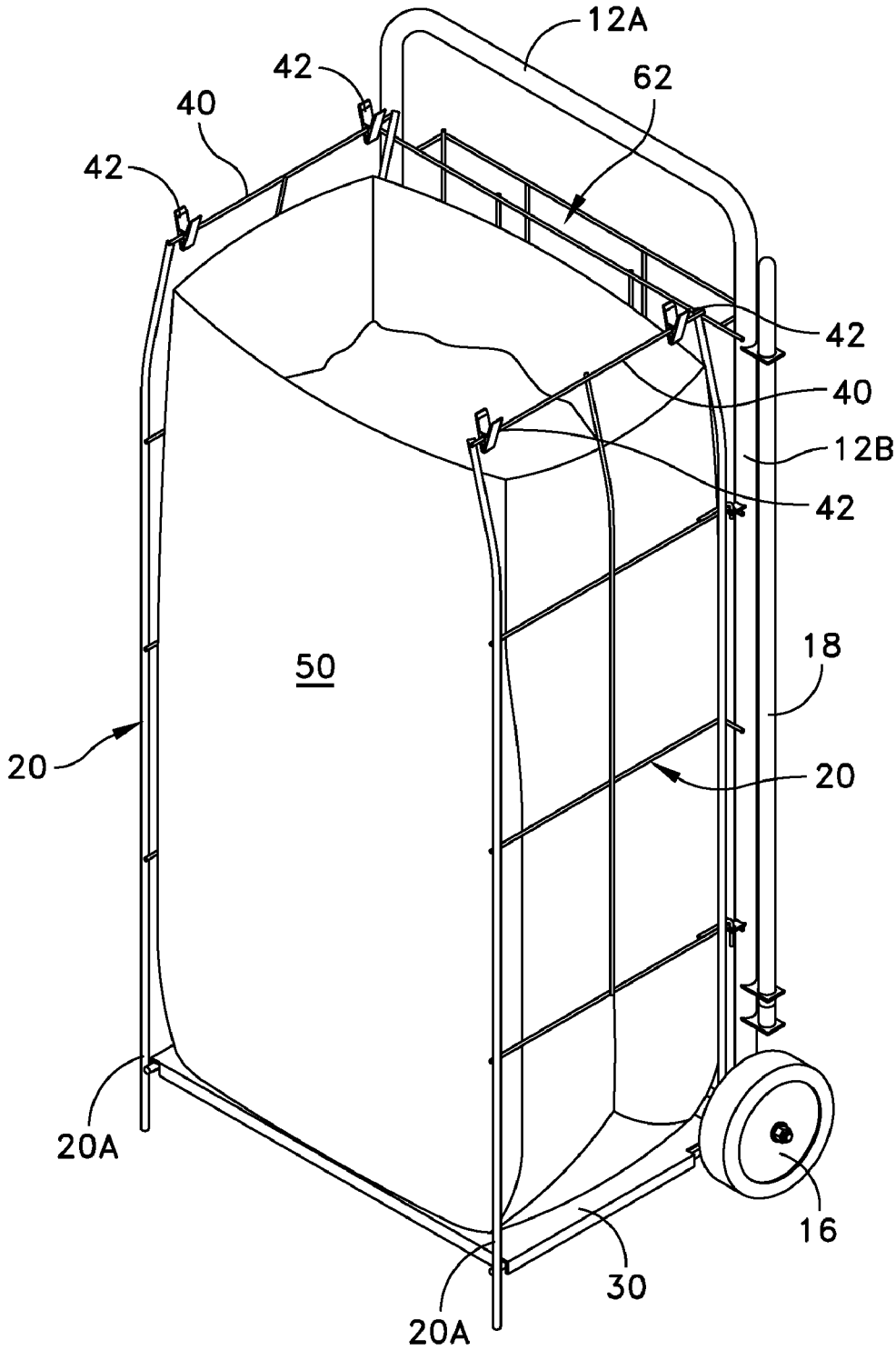
FIG. 11 is a perspective view similar to that shown in FIG. 10 but with the bag substantially filled so that the bag is released from the securing clips.

The sidewalls 20 are constructed of a series of wire members that are, as illustrated in the drawings, interconnected in a grid pattern. Where each wire passes a transverse wire it may be tack welded or secured in another manner so that the entire sidewall is in one piece. The sidewalls 20 also include a top wire 40 that extends between upright legs and that holds alligator securing clips 42. The clips 42 are of conventional design and are pivotal about the wire 40. Refer also to the enlarged fragmentary view of FIG. 9 that shows one of the clips 42. FIG. 9 also shows the clip 42 engaging an upper edge of the bag 50. Refer also to FIG. 10 that shows the bag 50 in place and secured at four locations, two on either side, to the upper edge of the respective wires 40.

Preferably, the upper end of the sidewalls is tapered inwardly at opposed sides as illustrated in, for example, FIG. 10 at 45. In this way, there is a space provided below that taper point where the bag is enabled to expand. The space is shown on either side of the bag. This space provides room for the bag to expand as it is filled. The view of FIG. 10 may be considered as where the bag is either empty or only partially filled so that the sides of the bag are not bulging out to any great extent. FIG. 10 also shows a space X at the bottom of the bag. This is also preferred so as to leave some space for the bag to expand. On the other hand in the perspective view of FIG. 11 this shows the bag 50 having been almost completely filled with leaves and/or debris and thus expanded in a radial direction bottom to top. As the leaves enter the bag and are tamped down, such as with the use of the stick 18, the bag 50 tends to lower in position and when the bag is sufficiently full the top edges of the bag disengage automatically from the clips 42 enabling the bag to be easily withdrawn from the bag carrier.

The carrier or cart of the present invention also includes what may be considered a rear wall 60 that, in the embodiment that is disclosed, is comprised of a series of wires that may be permanently attached to the handle legs 12B. The rear wall 60 may be constructed in a grid pattern with the wires intersecting by being attached to each other as well as to the legs 12B. The rear wall 60 is also preferably provided with a wire pocket 62. This pocket 62 is shown in, for example, FIGS. 1 and 13 and is in the form of a wire box that is relatively thin in construction. The pocket 62 is for retaining bags in their folded condition. This is quite convenient for the storage of multiple bags directly in the carrier and ready for use once they are opened and placed in the clips.

As indicated previously, an alternate embodiment of the invention is shown in FIGS. 13-15. This includes a removable intermediate wall 70. FIG. 13 illustrates the wall 70 as being a metal grid consisting of a series of transverse wires that may be welded together in the grid pattern illustrated. Note that the wall 70 also is provided with a pair of clips 72 similar to the previously mentioned clips 42. The intermediate wall 70 may be secured to both the rear wall and the base by means of clips 36. FIG. 15 illustrates the bag 58 in place in one of the compartments defined between the sidewall and the intermediate wall 70. FIG. 15 also shows the securing clips 42 and 72 that may be attached to the top edge of the respective bags.

The preferred embodiment is shown in FIGS. 16-23, and describes a lawn bag carrier that is basically comprised of a main frame 112 that includes a handle bar 112A and side legs 11213 that are integrally formed with the handle bar 112A. A cover 112C may be provided over the handle bar 112A to provide a better grip on the cart. At the lower ends of the legs 1128 there is supported an axle 114 that supports at either end thereof a wheel 116. The axle 114 and wheels 116 may be of conventional design. This arrangement enables the carrier to be easily rolled from place to place. One of the legs 11213 may be provided with a pole support means as illustrated previously in the first embodiment that was described herein.

In embodiment described in FIGS. 16-23 the carrier also includes sidewall members 120, each of which is in the form of interconnected metal rods forming a grid pattern and including front legs 120A. The bottom of each leg 120A may be pointed so that the carrier, when in its usable position, can be partially stuck into the ground for securing the position of the carrier. As illustrated in, for example, FIG. 16 each sidewall 20 is formed by welding together separate wires into a grid pattern. Although a grid arrangement is preferred, in accordance with the present invention other sidewall arrangements may be provided including, but not limited to, a relatively flat and light weight sheet material.

Figure 17:
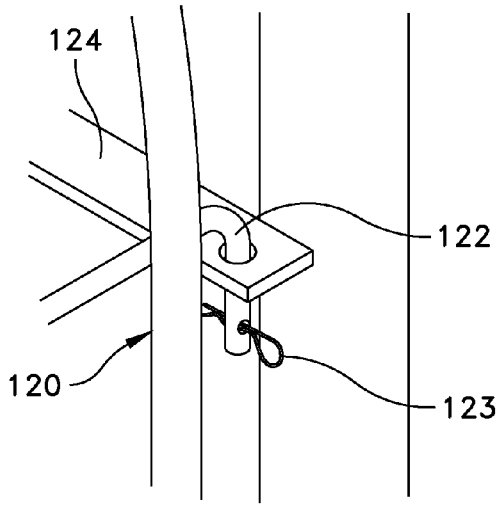
FIGS. 17 and 18 are a fragmentary perspective views illustrating the removable attachment of the sidewall member with the main frame.
Figure 18:
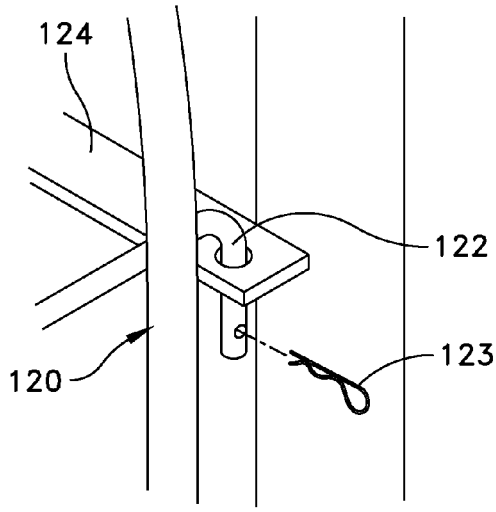

The sidewalls 120 are preferably releasably or removably supported and for that purpose associated with each sidewall is a hook 122 that engages with a hole in the plate 124. The plates 124 are spatially disposed and secured to each of the respective legs 112B of the main frame of the carrier. Refer now also to FIGS. 17 and 18 which show further details of the hook 122 and the plate 124 that is engaged by the hook. The lower hook 122 may be made longer than the upper located hooks so as to easily guide the upper hook into its associated tab. FIG. 17 shows the sidewall 120 in its engaged position with the plate 124, while FIG. 18 illustrates the sidewall 120 ready to be disengaged from the associated plate 124. This engagement of the hook 122 at the plate 124 also provides a pivot so that the sidewalls can be pivoted inwardly such as was illustrated in FIG. 12 where one of the sidewalls is shown partially folded to convert the cart for storage thereof. In the drawings two hooks and tabs are used, but it should be understood that more than two may be provided. FIGS. 17 and 18 also show one means for securing the sidewalls in place in the form of a cotter pin 123. However, other means may also be provided to secure the sidewalls in place. In any case the sidewalls preferably pivot relative to the main frame, as described before.

Figure 19:
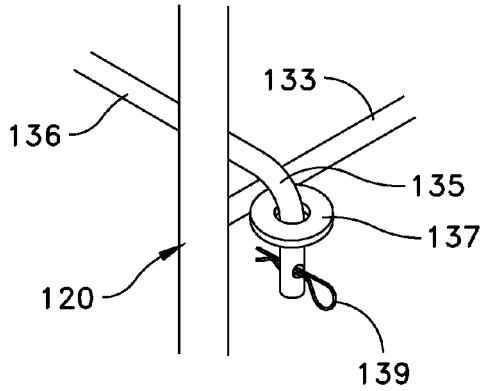
FIGS. 19 and 20 are fragmentary perspective views illustrating the removable attachment of the base with the sidewall members.
Figure 20:
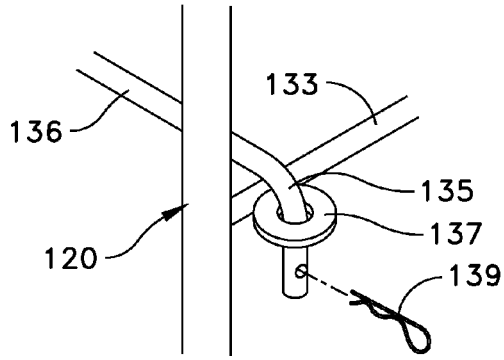
Figure 21:
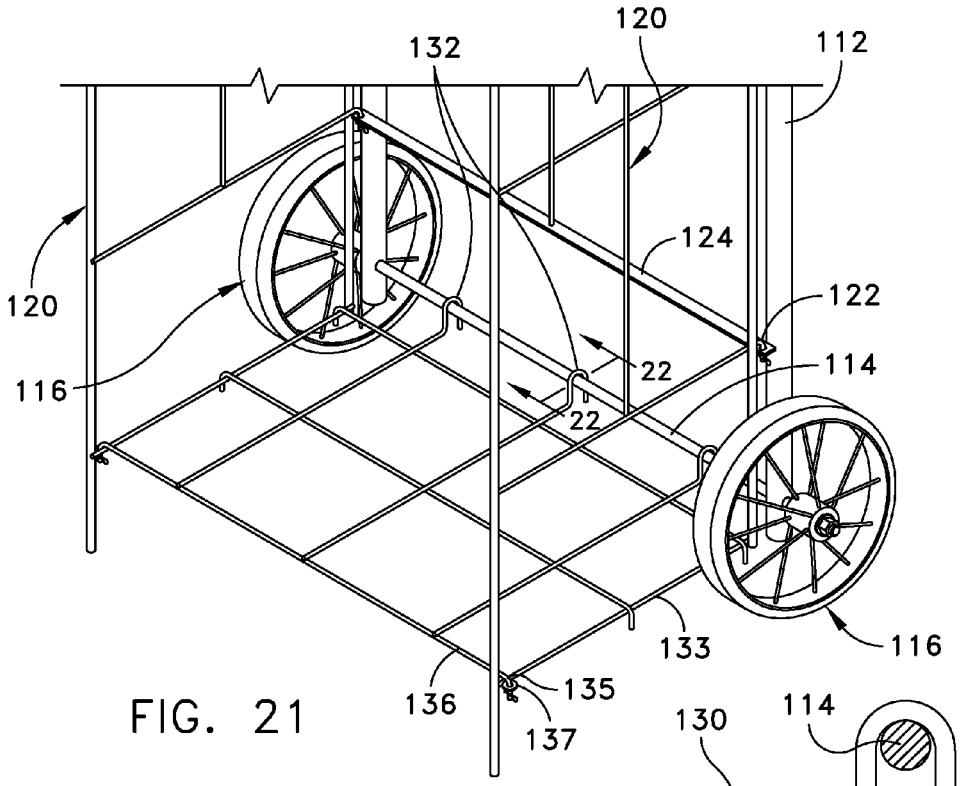
FIG. 21 is a partial perspective view at the lower part of the cart of FIG. 19.
Figure 22:
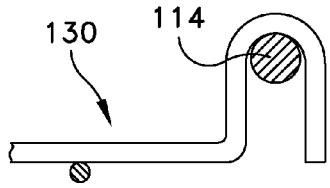
FIG. 22 is a cross-sectional view taken along line 22-22 of FIG. 21.
Figure 23:
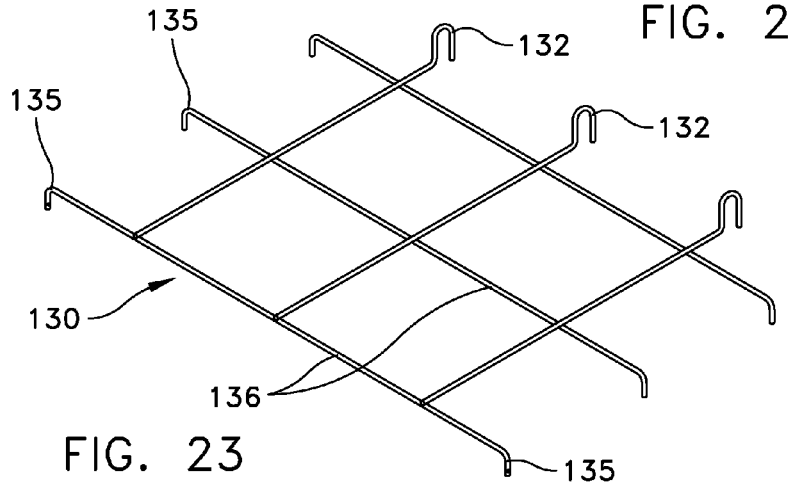
FIG. 23 is a perspective view of the grid base in the embodiment of FIG. 16.

In the embodiment of FIGS. 16-23 the bag cart also includes a bottom or base wall 130 that is constructed and arranged so as to be removably secured with the axle 114. For this purpose there are provided loops 132 as part of the base 130. In this particular embodiment the base is in the form of a grid structure made of crossed wires that may be attached together by spot welding where the wires cross each other. Refer to FIGS. 19 and 20 that show these loops 132 mounted about the axle 114. See also FIG. 23 which shows the base alone, and in which this particular embodiment uses three loops 132. Once the base is removed then the sidewalls can be pivoted in the same manner as previously described in connection with the first embodiment that was described herein.

As illustrated in FIGS. 19-23, the base 130 is shown in the form of a grid pattern having the aforementioned loops 132. The base 130 also includes side hooks 135 at the ends of a series of cross wires 136. Each sidewall also includes a bottom wire 133 that has attached thereto a washer tab 137 having a hole for receiving the hook 135. A cotter pin 139 is shown for attaching the hooks in place in FIGS. 19 and 20. Other ones of the end hooks 135 simply rest on the bottom wire 133.

As indicated previously, once the bag is filled with leaves or other debris, the top edge of the bag disengages automatically from the securing clips. In that position the bag can then be easily removed from the carrier. One of the advantages of the bag carrier of the present invention is that, because it is a wheeled device, the structure with a full bag can be wheeled to the curb where the bags can be picked up and/or disposed of.

Figure 1:
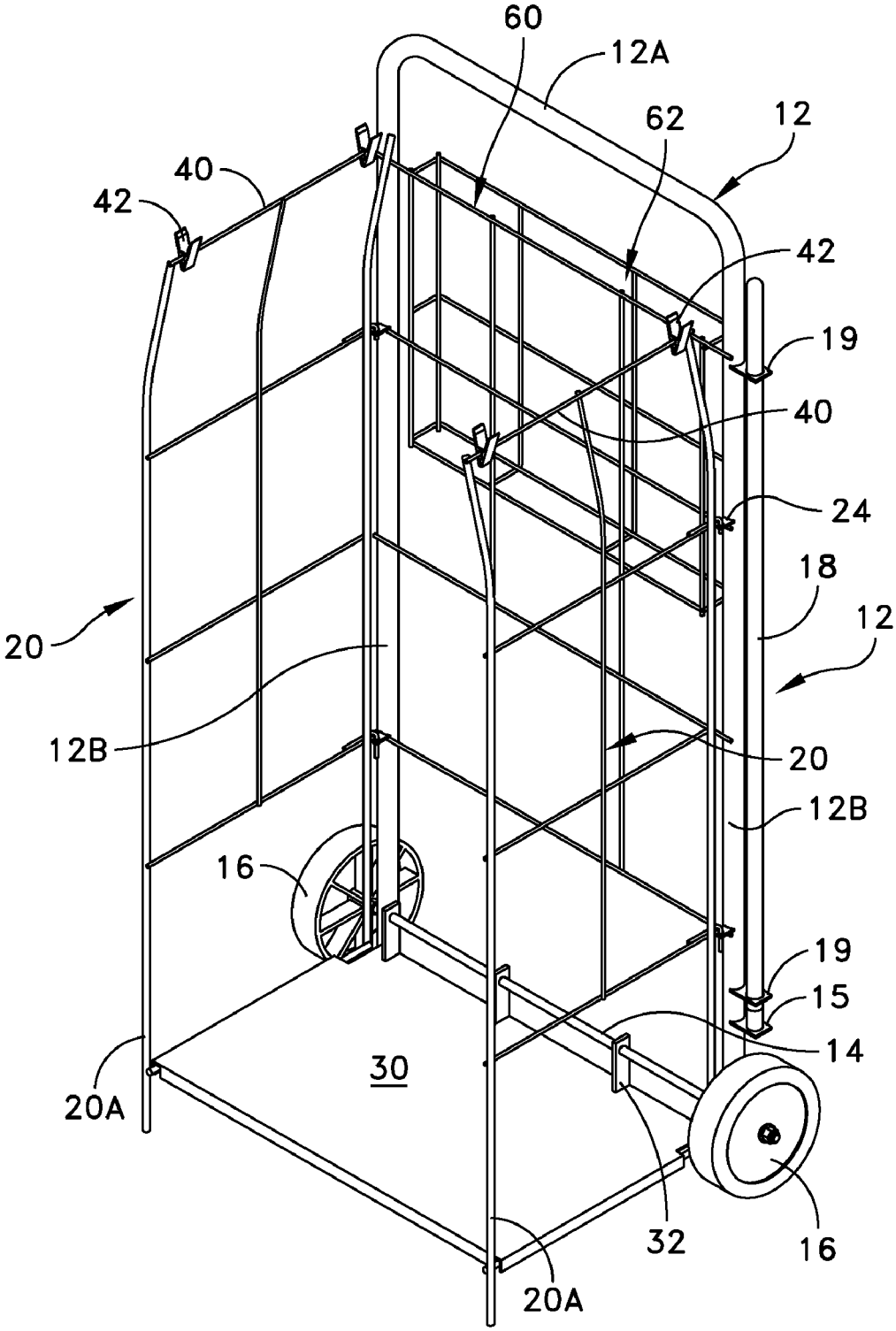
FIG. 1 is a perspective view of one embodiment of the bag carrier of the present invention.

Another feature of the cart of the present invention is that the taper at the sidewalls enables a simple way to provide a space preferably on both sides of the cart. This space enables some room so that the bag can expand as it is filled. In the past that expansion, when a simple barrel arrangement was used, caused the bag to be wedges in the container making it difficult to remove. On the other hand, with the structure of the present invention because a space is provided alongside the bag then there is some additional room to allow for the expansion of the bag as it is being filled with leaves or the like. Also, there is preferably provided a space below the bag as illustrated in FIG. 10. This space is also important in allowing some lowering of the bag as it becomes filled so that it automatically disengages from the clips. The side space is illustrated as being provided by making each sidewall member taper at the top, such as illustrated in FIG. 1 and at 160 in FIG. 16. In an alternate embodiment the sidewall member may taper at only one side thereof with the other side remaining upright and straight. The space on each side may be on the order of one inch and is in a range of ½ to 2 inch. The space at the bottom of the bag may also be on the order of one inch and is in a range of ½ to 2 inch.

Having now described a limited number of embodiments of the present invention, it should now be apparent to those skilled in the art that numerous other embodiments and modifications thereof are contemplated as falling within the scope of the present invention as defined by appended claims.

What is claimed is:

1. A bag holding apparatus for supporting one or more bags that are used for the purpose of depositing and storing leaves or other lawn debris, said apparatus comprising:

a base platform upon which a full bag rests;

at least two wheels interconnected by an axle shaft and for supporting the base platform;

an upright main frame mounted from the base platform and disposed over the wheels;

sidewall members also supported over the base platform and defining with the main frame an open compartment for receiving the bag therein;

each of the sidewall members having a lower section thereof positioned to leave a space between the sidewall member and an edge of the bag and an upper section extending inwardly of the compartment;

and clips secured at the upper section of each sidewall member for holding an edge of the bag;

said base platform comprising a base member and at least one pivot piece for pivotally supporting the base member from the axle shaft so as to enable the base member to be pivoted from a substantially horizontal position to an upwardly folded position.

2. The apparatus of claim 1 wherein the sidewall members each include at least one pivot member that enables the respective sidewall members to be pivoted from a substantially parallel relative position to a more folded position wherein the sidewall members are pivoted toward each other.

3. The apparatus of claim 2 wherein each sidewall member includes a bottom wire piece and said base member includes a flat base that has side edges that engage respective bottom wire pieces to hold the sidewall members in place.

4. The apparatus of claim 2 wherein each bag has a predetermined bag width and height, and the distance between the lower sections of the sidewall members is greater than the predetermined width of the bag so as to leave said space, wherein the main frame includes side legs and wherein the pivot piece comprises a pivot plate and the pivot member comprises a tab and hook that enable the sidewall member to pivot from the leg as well as be raised for dis-engagement from the leg.

5. The apparatus of claim 4 wherein the lower sections of the respective sidewall members leaves a space on the order of 1 inch on either side thereof.

6. The apparatus of claim 4 wherein each sidewall member has a height that is greater than the predetermined bag height so as to leave a space below the bag.

7. The apparatus of claim 1 wherein the at least one pivot piece includes a pair of spaced apart pivot pieces for pivotally supporting the base member from the axle shaft and said at least one pivot member includes a pair of pivot members that are spaced apart vertically.

8. The apparatus of claim 1 further including a pocket at the top of the main frame for retaining one or more bags therein in their folded condition.

9. The apparatus of claim 1 wherein each of the sidewall members comprises a metal sidewall grid and the upper section thereof includes a top wire piece from which the clip means is supported.

10. The apparatus of claim 9 wherein the clip means comprises a pair of alligator clips supported from each respective top wire piece.

11. The apparatus of claim 1 wherein each sidewall member comprises a metal sidewall grid and the upper section thereof includes an inwardly tapered section.

12. A bag holding apparatus for supporting one or more bags that are used for the purpose of depositing and storing leaves or other lawn debris, said apparatus comprising:

a base platform upon which a full bag rests;

at least two wheels interconnected by an axle shaft and for supporting the base platform;

an upright main frame mounted from the base platform and disposed over the wheels;

sidewall members also supported over the base platform and defining with the main frame an open compartment for receiving the bag therein;

each of the sidewall members having a lower section thereof positioned to leave a space between the sidewall member and an edge of the bag and an upper section extending inwardly of the compartment;

and clip means secured at the upper section of each sidewall member for holding an edge of the bag; and a compacting pole and tab means for supporting the compacting pole from the main frame.

13. The apparatus of claim 12 wherein the upright main frame includes a horizontal handle bar and a pair of vertical side legs.

14. The apparatus of claim 13 including a stop on one of the side legs below the tab means that functions as a stop for the pole.

15. A bag holding apparatus for supporting one or more bags that are used for the purpose of depositing and storing leaves or other lawn debris, said apparatus comprising:

a base platform upon which a full bag rests;

at least two wheels interconnected by an axle shaft and for supporting the base platform;

an upright main frame mounted from the base platform and disposed over the wheels;

sidewall members also supported over the base platform and defining with the main frame an open compartment for receiving the bag therein;

each of the sidewall members having a lower section thereof positioned to leave a space between the sidewall member and an edge of the bag and an upper section extending inwardly of the compartment;

and clip means secured at the upper section of each sidewall member for holding an edge of the bag; and a vertically disposed divider wall extending from the base platform and forming separate side-by-side compartments for receiving respective bags.

16. A bag holding cart for supporting one or more bags that are used for the purpose of depositing and storing leaves or other lawn debris, said cart comprising:

a base platform upon which a full bag rests;

means for supporting the base platform so that the cart is mobile;

an upright main frame mounted from the base platform and including a handle bar connected with side legs;

sidewall members also supported over the base platform and defining with the main frame an open compartment for receiving the bag therein;

each of the sidewall members comprised of a grid sidewall of interconnected wires including a top wire;

each of the sidewall members having a lower section thereof positioned to leave a space between the sidewall member and an edge of the bag and an upper section tapered inwardly of the compartment;

and clip means secured at the upper section of each sidewall member at the top wire and for holding an edge of the bag;

said sidewall members each include at least one pivot member that enables the respective sidewall members to be pivoted from a substantially parallel relative position to a more folded position wherein the sidewall members are pivoted toward each other.

17. The apparatus of claim 16 wherein said base platform comprising a base member and at least one pivot piece for pivotally supporting the base member from the axle shaft so as to enable the base member to be pivoted from a substantially horizontal position to an upwardly folded position.

18. The apparatus of claim 16 wherein each bag has a predetermined bag width and height, and the distance between the lower sections of the sidewall members is greater than the predetermined width of the bag so as to leave said space; wherein the lower sections of the respective sidewall members leaves a space on the order of 1 inch on either side thereof; and wherein each sidewall member has a height that is greater than the predetermined bag height so as to leave a space below the bag.

19. A bag holding cart for supporting one or more bags that are used for the purpose of depositing and storing leaves or other lawn debris, said cart comprising:

a base platform upon which a full bag rests;

means for supporting the base platform so that the cart is mobile;

an upright main frame mounted from the base platform and including a handle bar connected with side legs;

sidewall members also supported over the base platform and defining with the main frame an open compartment for receiving the bag therein;

each of the sidewall members comprised of a grid sidewall of interconnected wires including a top wire;

each of the sidewall members having a lower section thereof positioned to leave a space between the sidewall member and an edge of the bag and an upper section tapered inwardly of the compartment;

clip means secured at the upper section of each sidewall member at the top wire and for holding an edge of the bag; and a vertically disposed divider wall extending from the base platform and forming separate side-by-side compartments for receiving respective bags.

20. A bag holding cart for supporting one or more bags that are used for the purpose of depositing and storing leaves or other lawn debris, said apparatus comprising:

a base platform upon which a full bag rests;

at least two wheels interconnected by an axle shaft and for supporting the base platform;

an upright main frame mounted from the base platform and disposed over the wheels;

sidewall members also supported over the base platform and defining with the main frame an open compartment for receiving the bag therein;

each of the sidewall members having a lower section thereof positioned to leave a space between the sidewall member and an edge of the bag and an upper section extending inwardly of the compartment;

and clip means secured at the upper section of each sidewall member for holding an edge of the bag;

wherein the base platform comprises one of a flat base and further including pivot means for pivotally supporting the flat base from the wheel axle and a removable base grid that is supported adjacent the main frame and also from the sidewall members;

wherein each sidewall member includes a bottom wire piece and said flat base has side edges that engage respective bottom wire pieces to hold the sidewall members in place;

a pocket at the top of the main frame for retaining one or more bags therein in their folded condition;

a compacting pole and tab means for supporting the compacting pole from the main frame;

wherein the upright main frame includes a horizontal handle bar and a pair of vertical side legs;

a stop on one of the side legs below the tab means that functions as a stop for the pole;

wherein each of the sidewall members comprises a metal sidewall grid and the upper section thereof includes a top wire piece from which the clip means is supported;

wherein the clip means comprises a pair of alligator clips supported from each respective top wire piece;

wherein each bag has a predetermined bag width and height, and the distance between the lower sections of the sidewall members is greater than the predetermined width of the bag so as to leave said space;

wherein the lower sections of the respective sidewall members leaves a space on the order of at least 1 inch on either side thereof;

wherein each sidewall member has a height that is greater than the predetermined bag height so as to leave a space below the bag;

wherein each sidewall member comprises a metal sidewall grid and the upper section thereof includes an inwardly tapered section.

21. The apparatus of claim 20 including a vertically disposed divider wall extending from the base platform and forming separate side-by-side compartments for receiving respective bags.

* * * * *